US005215791A

United States Patent [19]

Davignon

[11] Patent Number: 5,215,791

[45] Date of Patent: Jun. 1, 1993

[54] ORNAMENTAL DEVICE AND METHOD OF FORMING IT

[75] Inventor: Elizabeth A. Davignon, Cranston, R.I.

[73] Assignee: Kirk's Folly, Inc., Providence, R.I.

[21] Appl. No.: 682,437

[22] Filed: Apr. 8, 1991

[51] Int. Cl.[5] ..... D04D 7/10

[52] U.S. Cl. ..... 428/5; 28/147; 223/46; 428/11; 428/102; 428/255

[58] Field of Search ..... 428/7, 11, 102, 255, 428/4, 5; 28/147; 223/46

[56] References Cited

U.S. PATENT DOCUMENTS

| | | | |
|---|---|---|---|
| 880,572 | 3/1908 | Prentice | 428/67 |
| 1,666,099 | 4/1928 | Kingman | 428/11 |
| 3,442,736 | 5/1969 | Duns | 428/255 X |
| 3,708,804 | 1/1973 | Santos | 428/11 X |
| 3,950,584 | 4/1976 | Bramley | 428/255 X |
| 4,275,028 | 6/1981 | Cohen | 428/255 X |
| 4,521,986 | 6/1985 | Koga | 428/255 X |

FOREIGN PATENT DOCUMENTS

| | | | |
|---|---|---|---|
| 630364 | 10/1949 | United Kingdom | 428/255 |

*Primary Examiner*—Henry F. Epstein

*Attorney, Agent, or Firm*—Salter, Michaelson & Benson

[57] ABSTRACT

Ornamental device having compartments formed of net-like foraminous material and containing sparkle elements which are larger than the openings in the material, but having appendages whose outer ends are smaller than the openings so as to engage therein to inhibit movement of the sparkle elements within the compartments.

14 Claims, 2 Drawing Sheets

ORNAMENTAL DEVICE AND METHOD OF FORMING IT

BACKGROUND OF INVENTION

Many devices have been developed over the years for enhancing feminine appearance, but one of the most popular types consists of the use of a tulle fabric on which sparkle elements, such as sequins, are mounted. This type of ornamented fabric has been used for veils, formal dresses, and ballet skirts. It has not, however, come into common use for a number of reasons.

One deficiency of the prior art fabric of this type has been the fact that it is necessarily expensive, because of the hand work that has been necessary to apply the sparkle elements. In the case of sequins, the traditional method of attachment has been by sewing each individual sequin in place. The expense also rises if a large number of sparkle elements are used. Of course, attempts have been made to fasten the sparkle elements by using glues and cements, but these apparently have also caused problems. For instance, many of the cements soften at high temperature, so that the sparkle elements fall off. In other cases, they are so brittle that normal rubbing that takes place during the wearing of the dress, etc., cause a breakage and release of the sparkle element. These and other difficulties experienced with the prior art devices have been obviated in a novel manner by the present invention.

It is, therefore, an outstanding object of the invention to provide an ornamental device that makes use of a net-like material having sparkle elements, but which device is relatively inexpensive.

Another object of this invention is the provision of an ornamental device in which sparkle elements are applied to a netted material, such as tulle, in such a way that the elements remain in place despite intensive use.

A further object of the present invention is the provision of a decor-enhancing means in which sparkle elements are applied to a net-like material with a minimum of manual labor.

A still further object of the invention is the provision of an ornamental material which is simple and rugged in construction, which can be easily manufactured from readily-available materials, and which is capable of a long life of useful service with a minimum of maintenance.

It is a further object of the invention to provide an ornamental fabric display having sparkle or sequin elements, wherein the sparkle elements are automatically maintained in a shining condition and do not easily become tarnished.

Another object of the invention is the provision of an ornamental device in which an arrangement of sparkle elements can be easily varied as desired.

With these and other objects in view, as will be apparent to those skilled in the art, the invention resides in the combination of parts set forth in the specification and covered by the claims appended hereto.

SUMMARY OF THE INVENTION

In general, the present invention is concerned with an ornamental device having a main envelope that is divided into a plurality of compartments, each compartment being defined by at least one sheet of a net-like fabric. A plurality of sparkle elements are contained in each compartment, each element being larger that an opening in the fabric. Each sparkle element has an appendage that is smaller at its outer end than the said opening in the fabric.

More specifically, the ornamental device is formed by combining two sheets of the net-like fabric to form an open-ended envelope, inserting the sparkle elements in the envelope so that they lie in a selected restricted portion, and then forming a fold or seam across the envelope to totally enclose the said portion, thus providing the compartment containing the sparkle elements.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
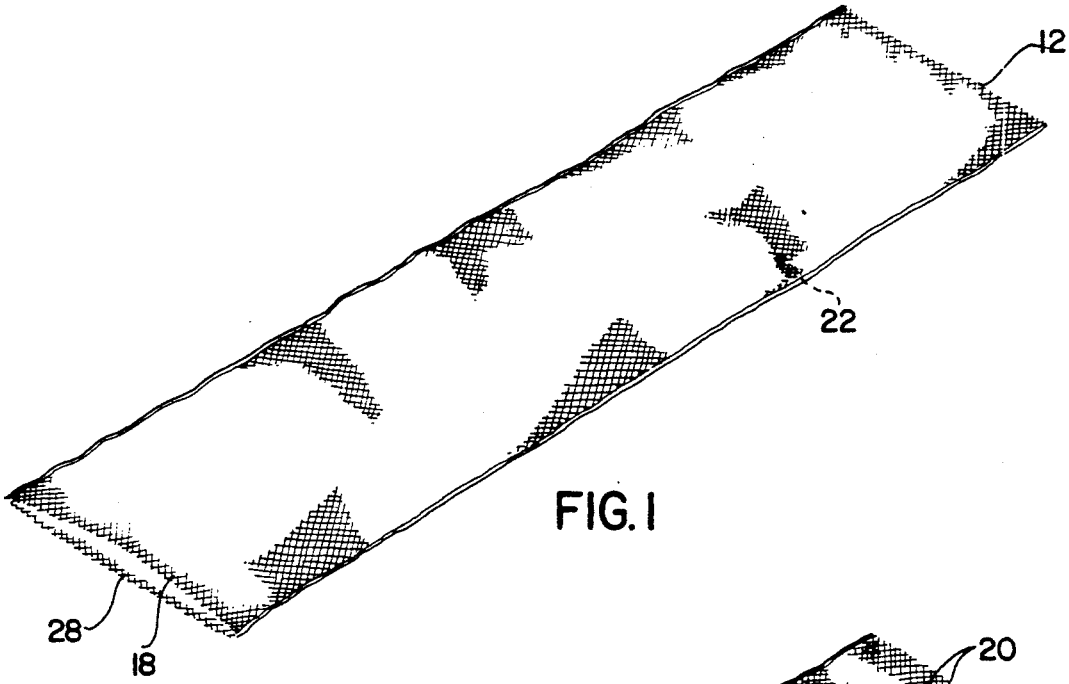
FIG. 1 is a perspective view of the ornamental device incorporating the principles of the present invention, shown at an early stage of its construction.
Figure 2:
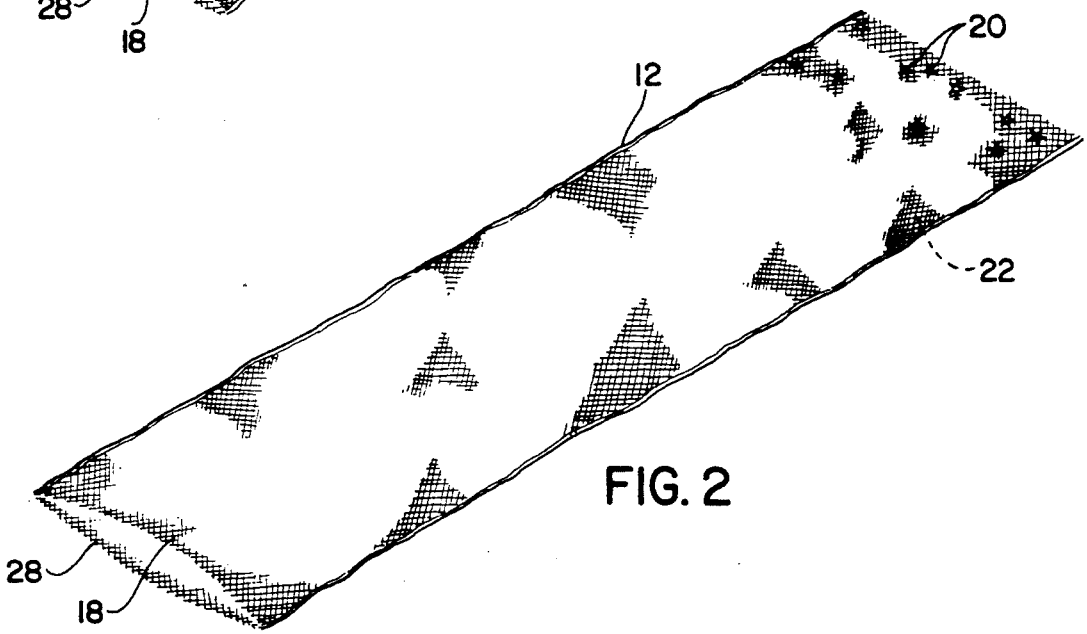
FIG. 2 is a perspective view of the invention at a second stage in its construction.
Figure 3:
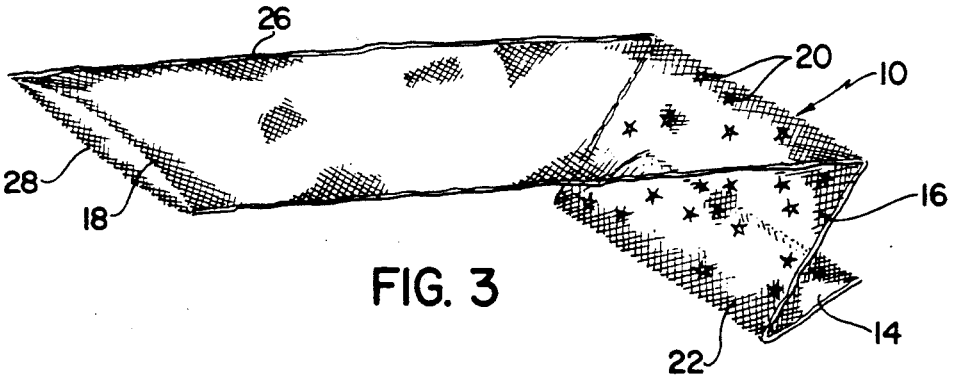
FIG. 3 is a perspective view of the ornamental device, shown at a third stage of its construction.
Figure 4:
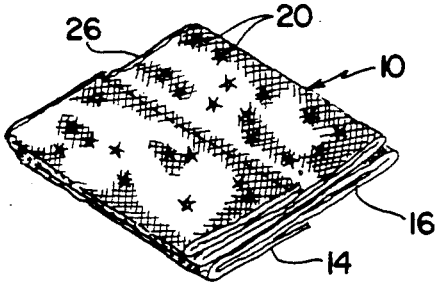
FIG. 4 is a perspective view of the invention at a fourth stage in its construction.
Figure 5:
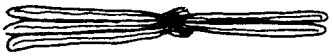
FIG. 5 is an end elevational view of the invention in the stage shown in FIG. 4.

FIGS. 1, 2, 3 and 4 demonstrate the novel method used to make the ornamental device, indicted generally by the reference numeral 10. In FIG. 1, it can be seen that two sheets 18 and 28 of tulle are combined to form an open-ended envelope 12. As shown, the sheets are similar elongated rectangles that are stitched along two edges, leaving the end edges open. Sparkle elements 20 are inserted, as in FIG. 2, and are placed at one end in a restricted portion or area. These sparkle elements are larger in size than the openings and have appendages that are smaller at their outer ends than the openings. Folds are formed across the envelope to restrict the sparkle 14 elements to their own portions or compartments 14, 16, etc. In most situations, it will be sufficient to accomplish this division into compartments simply by folding the envelope sharply along transverse lines. After completely folding the envelope into compartments, as shown in FIGS. 4 and 5, the bundle is stitched completely across, thus closing the ends of the envelope and completing the formation of the plurality of compartments that enclose the sparkle elements 20.

Referring next to FIGS. 3 and 4, which best show the general features of the invention, the ornamental device 10 is shown as including the main envelope 12 having a plurality of compartments 14 and 16. Thus, each compartment is defined by at least one sheet 18 of a net-like material. In the preferred embodiment of the invention, this material is a synthetic tulle, but silk and other similar transparent net fabrics can be used.

Each compartment 14, 16 contains a plurality of glitter or sparkle elements 20, each such element being larger than the mesh or opening 22 in the net-like material. In addition, each sparkle element has an appendage 24 (see FIG. 5) that is smaller at its outer end than the said opening in the material.

Figure 6:
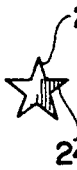
FIGS. 6, 6*a*, 6*b* and 6*c* show different forms of a sparkle element used in the invention.
Figure 6B:
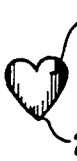
Figure 6A:
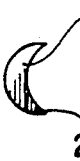
Figure 6C:
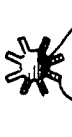

FIG. 6 shows the sparkle element 20 to be in the form of a star, whose points constitute the appendages 24 which are smaller at their outer ends than the openings in n the net-like material Similarly, FIG. 6*a* shows a sparkle element 20*a* in the form of a crescent moon having pointed horns 24*a*. FIG. 6*b* shows a sparkle element 20*b* in the shape of a stylized heart that is provided with a pointed cusp 24*b*. A sparkle element 20*c* is demonstrated in FIG. 6*c* and is in the shape of a sun having thin radial rays 24*c*.

In the preferred embodiment of the invention, the sparkle elements 20, etc., are formed of a plastic material such as Mylar (duPont trademark) or a foil material that is stamped into the forms shown, i.e., stars, crescents, hearts, suns, and the like. In each form selected, the shape is provided with at least one narrow-ended appendage. In addition, the preferred embodiment has compartments that are made up of two sheets 18 and 28 of the net-like material that are sewn together at their edges. In the form of the invention shown in FIGS. 3 and 4, the compartments are arranged sequentially to form a ribbon 26.

Figure 7:
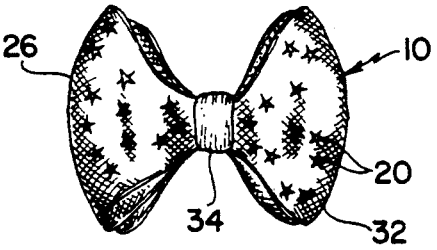
FIG. 7 is a perspective view of a completed form of the ornamental device.

FIG. 7 shows the manner in which the ribbon 26 can be formed into a bow 32 with the sparkle elements 20 displayed neatly on facing surfaces. A strip 34 of material similar to that in the ribbon is wrapped around the center of the bundle of ribbon, shown in FIG. 2, to form the bow. Such a bow can be effectively used as an ornament on a dress or in the hair.

Figure 8:
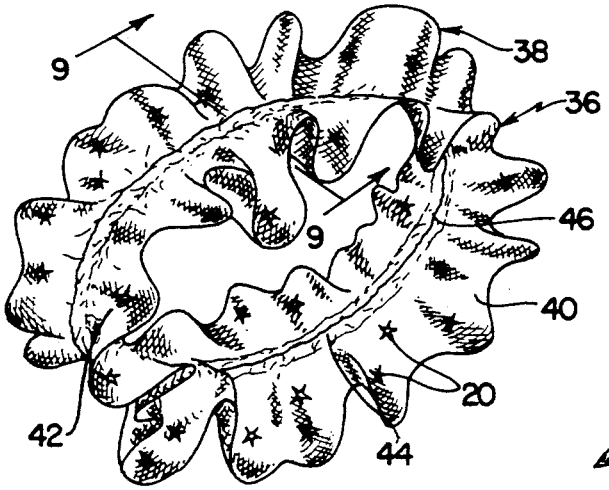
FIG. 8 is a perspective view of a modification of the ornamental device.
Figure 9:
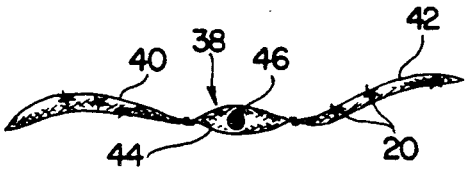
FIG. 9 is a sectional view of the ornamental device, taken of the line 9—9 of FIG. 8.

FIGS. 8 and 9 show a modified form of the invention, in which the ornamental device 36 is intended for use to hold a "pony-tail" hairdo in place. An envelope 3 is divided into two elongated, parallel compartments 40 and 42, each compartment containing a plurality of the sparkle elements 20, etc. of the type previously described. In other words, the sparkle elements are larger than the openings in the net-like material, but have appendages that are smaller than those openings. The adjacent edges of the compartments 40 and 42 are joined by an annular strip 44, which, as is clearly shown in FIG. 9, has a central elastic ring 46. The strip 44 is sewn to the compartments in such a way that the compartments are formed with ruffles and maintained in that condition.

The operation and the advantages of the present invention will now be readily understood in view of the above description. For instance, it is clear that the basic construction of the ornamental device 10 can be used in a number of configurations for the enhancement of feminine apparel, hair, or accessories. FIG. 7 shows one form that can be used, namely as a bow. FIG. 8 shows how the principle of the invention can be used in an elastic ring for application to the hair. When the invention is used, for instance, in the configuration shown in FIG. 3, the sparkle elements 20 are in the shape of stars. When the sparkle elements are more or less evenly distributed within the compartment 14, the stars cannot escape, because they are larger than the openings 22 in the mesh. Furthermore, the appendages or points of the stars extend into the openings in the mesh and lock the star in place. The simple act of handling the bow 32 will tend to re-distribute the stars evenly throughout the compartment 14. If, however, the sparkle elements accumulate at the bottom of the compartment, it is a simple matter to invert the bow and the compartment to move the stars into a more pleasing distribution.

It is evident, then, that it is not necessary to fasten the sparkle elements individually to the net-like material, because they are not only enclosed in their respective compartments, but they also lock in place and are inhibited from moving within the compartment by the engagement of the points or appendages with the openings in the mesh. This method of assembly, therefore, involves very little manual labor, and the cost of manufacture is substantially reduced from the prior art methods of attaching sparkle elements In addition, the appearance of the finished product is rather novel, because the shining surfaces of the sparkle elements show through the openings in the mesh, but at the same time, are very unlikely to become entangled with other clothing, etc. The sparkle elements are, of course, initially manufactured from polished material which normally would eventually become tarnished. In the present invention, however, the slight movement of the sparkle elements within the mesh compartment will serve to almost continuously polish the surfaces and prevent tarnishing.

It can be seen, then, that the invention has several advantages over the prior art, which advantages are in addition to the novel appearance of sparkle elements enclosed in net-like compartments. The manufacture is relatively inexpensive and the polished surfaces are practically self-maintaining. The novel structure of the invention lends itself to a large number of imaginative configurations in addition to the bow and hair elastic shown in the illustrated embodiments.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Ornamental device, comprising (a) a main envelope having a compartment defined by at least one sheet of flexible foraminous netting material, (b) a plurality of sparkle elements contained in said compartment, each element being larger than the openings in the material, and (c) each sparkle element having an appendage that is smaller at its outer end than said openings in the material, at least some of said outer ends extending through the openings to resist movement of their respective sparkle elements about said compartment.

2. Ornamental device as recited in claim 1, wherein the sparkle elements are formed of a high-lustre plastic and in the shape of stars.

3. Ornamental device as recited in claim 1, wherein the sparkle elements are formed of a high-lustre plastic and in the shape of either stars, crescent moons, hearts, or circles with radially-extending rays.

4. Ornamental device as recited in claim 1, wherein said compartment consists of two sheets of netting sewn together at their edges.

5. Ornamental device as recited in claim 4, wherein there are a plurality of compartments arranged sequentially.

6. Ornamental device as recited in claim 5, wherein sufficient sequential compartments are provided to form a ribbon, which ribbon is formed into a bow.

7. Ornamental device as recited in claim 5, wherein at least two of the compartments are generally elongated and mounted in parallel relationship.

8. Ornamental device as recited in claim 7, wherein the adjacent edges of the two elongated compartments are formed into a circle and are joined by an elastic strip.

9. Ornamental device as recited in claim 8, wherein each elongated compartment is ruffled and held in that condition by the elastic strip.

10. Method for making an ornamental device, comprising the steps of:

(a) combining two sheets of foraminous netting material to form an open-ended main envelope, (b) inserting a plurality of sparkle elements that are larger than the openings in the material within the main envelope and causing them to lie in a selected restricted portion, said sparkle elements having appendages that are smaller at their outer ends than the openings whereby at least some of said outer ends extend through the openings, and (c) forming a fold across the main envelope to totally enclose the said portion and define a compartment.

11. Method as recited in claim 10, including the step of forming a second similar compartment containing sparkle elements, the second compartment being joined in juxtaposition to the first-named compartment.

12. Method as recited in claim 11, including the successive steps of inserting and forming folds to provide a series of sequentially-located compartments.

13. Method as recited in claim 11, wherein the two compartments are elongated, are arranged in parallel, and are joined by an elastic strip.

14. Method as recited in claim 13, including the step of forming both compartments with ruffles.

* * * * *